United States Patent [19]

des Snead

[11] Patent Number: 4,708,075

[45] Date of Patent: Nov. 24, 1987

[54] MULTI-HULL SAILBOAT WITH FIXED AIRFOILS

[76] Inventor: Edwin des Snead, P.O. Box 1000, Georgetown, Tex. 78626

[21] Appl. No.: 9,710

[22] Filed: Feb. 2, 1987

[51] Int. Cl.[4] ..... B63B 35/00

[52] U.S. Cl. ..... 114/39.1; 114/61; 114/90

[58] Field of Search ..... 114/39, 39.1, 61, 90, 114/91, 272, 273, 281, 102

[56] References Cited

U.S. PATENT DOCUMENTS

| | | | |
|---|---|---|---|
| 3,802,366 | 4/1974 | Mankawich | 114/61 |
| 4,228,750 | 10/1980 | Smith et al. | 114/281 |
| 4,671,198 | 6/1987 | des Snead | 114/61 |

FOREIGN PATENT DOCUMENTS

| | | | |
|---|---|---|---|
| 3248049 | 8/1983 | Fed. Rep. of Germany | 114/39.1 |
| 2160165 | 12/1985 | United Kingdom | 114/39 |

*Primary Examiner*—Joseph F. Peters, Jr.
*Assistant Examiner*—Thomas J. Brahan
*Attorney, Agent, or Firm*—Hubbard, Thurman, Turner & Tucker

[57] ABSTRACT

A three hulled sailboat consists of a tripod frame having three downwardly inclined spars which define support points at their distal ends. During the sailing of the boat, one support point is always toward the windward, and the other two support points are leeward. A generally vertical mast spar supported on the frame has a masthead spaced equidistantly from the two lee support points and generally above the windward support point. Three buoyant hulls are coupled to the respective support points, the hulls being elongated with a high length-to-beam ratio, and being symmetrical about a transverse vertical plane for movement through the water in either direction. The hulls are coupled for independent rotation and steering relative to the frame and also for independent pitching relative to the frame about transverse central axes. Independent steering is provided for each of the three hulls relative to the frame. A flexible sail is mounted generally in a plane defined by the two lee support points and the masthead; and the foot of the sail is secured to a roller boom rotatably supported generally between the two lee support points. The sail is reeved by being taken up on the roller boom, and is raised by a halyard reeved over the masthead; and the sail is readily raised and reeved by the pilot so that any desired area of sail may be presented to the wind. The mast spar and two leeward spars are configured as fixed sail airfoils symmetrical about their longitudinal axes, with the chords of the airfoils fixed in planes parallel with a line between the two leeward support points.

20 Claims, 13 Drawing Figures

MULTI-HULL SAILBOAT WITH FIXED AIRFOILS

BACKGROUND AND SUMMARY OF THE INVENTION

This invention relates to a sailboat having a multiple hull structure, and including fixed airfoils for improved performance particularly when sailing into the wind.

All sailboats suffer from the problem that the wind is variable and not subject to control. This problem can be a serious one, when it is considered that the forces generated by the wind vary with the square of the wind velocity. For example, a 30-knot wind exerts nine times the force of a 10-knot wind.

For thousands of years sailors have responded to this problem by carrying larger or more sails in light winds, and fewer or smaller sails in strong winds. An alternative to the technique of changing sails in the technique of reefing, that is the gathering up of a portion of the sail and securing it against a spar. Although reefing makes it possible for a boat to survive and to make controlled maneuvers in high wind, its ability to sail to windward is reduced as the sail area is reduced. A boat that can sail with full sail in any direction within a 270° arc, may be limited to a 180° or less when the sail is triple reefed, or reduced by two-thirds. Under such conditions, a boat could be wrecked on a lee shore while under perfect control.

The reason for the reduction in the ability of a boat to sail into the wind when the sail is reefed, is the reduction in the overall efficiency of all of the rigging exposed to the wind. The sail itself may be highly efficient, with a lift-to-drag ratio of 10 corresponding to a drag angle of 6°. However, all of the standing rigging including mast, stays, shrouds and spreaders have lift-to-drag ratios of zero for a drag angle of 90°. The boat, as a whole, responds to the net combined drag angle of all of the parts exposed to the wind. With the full sail aloft, the net combined drag angle may be as low as 15° or 20°; and this would allow the boat to sail within 40° or 45° of the eye of the wind. As the sail area is reduced (the component of the rigging with the desirable drag angle), the combined drag angle of all of the rigging increases. With no sail aloft, the overall drag angle is 90°; and in this condition the courses available to the boat are restricted to generally downwind and perhaps 45° to either side of downwind.

Assuming for purposes of discussion that the mast and all other rigging are cylindrical. A cylinder, and therefore all of these rigging components, have a lift-to-drag of zero and a drag angle of 90°. The drag for a cylindrical member is roughly proportional to the diameter. On a medium size sailboat, the mast might be 6 inches in diameter and the rest of the rigging about ¼ inch wires. The mast, then, is responsible for more drag than all of the other standing rigging combined.

An object of this invention is to provide an improved sailboat which will sail more efficiently in both light winds and strong winds.

Another object of this invention is to provide an improved sailboat having both fixed and flexible sails, wherein the boat is able to beat to windward on either tack without the benefit of the flexible sail.

A further object of this invention is to provide an improved sailboat wherein a heavy rigging spar is formed as an airfoil to reduce drag and provide lift, thereby improving substantially the lift-to-drag ratio of the boat frame and rigging.

Still another object of this invention is to provide an improved sailboat wherein the exposed spars are configured as airfoils to reduce drag and provide lift to enable the sailing of the boat without the flexible sail, and wherein the presented sail area of the flexible sail may be changed readily from 0 to 100 percent.

These objects are accomplished in a sailboat having the following structural features. A tripod boat frame is supported on the water by three independent buoyant hulls. The tripod frame includes three spars extending outwardly and downwardly from a center juncture point, and provides hull support points at the respective distal ends of these spars. These frame spars include a windward spar providing a windward support point and two leeward spars providing two leeward support points. A mast spar is mounted on the frame at the center juncture point, with its masthead disposed equidistant from the leeward support points and toward the windward support point. The three independent buoyant hulls are coupled to the three frame support points. An independent direction control and steering means is provided for each of the three hulls. The mast spar is configured, at least in part, as an airfoil symmetrical about its longitudinal axis with both edges as leading edges, and with the chord of the airfoil being fixed in a plane parallel with a line between said leeward support points.

More particularly, the leeward spars are each configured, at least in part, as an airfoil symmetrical about its longitudinal axis with both edges as leading edges, with the chord of the airfoil being fixed in a plane parallel with a line between the leeward support points.

Still more particularly a sail is mounted on the sailboat for disposition generally in a plane defined by the two leeward support points and the masthead, whereby the sail is inclined from the leeward support points toward the windward support point.

Still more particularly, the sail has its foot attached to a roller boom extending between the leeward support points, whereby the sail may be reefed by rolling onto the boom to present 0 percent to 100 percent sail area to the wind.

The novel features and the advantages of the invention, as well as additional objects thereof, will be understood more fully from the following description when read in connection with the accompanying drawings.

DRAWINGS

Figure 1:
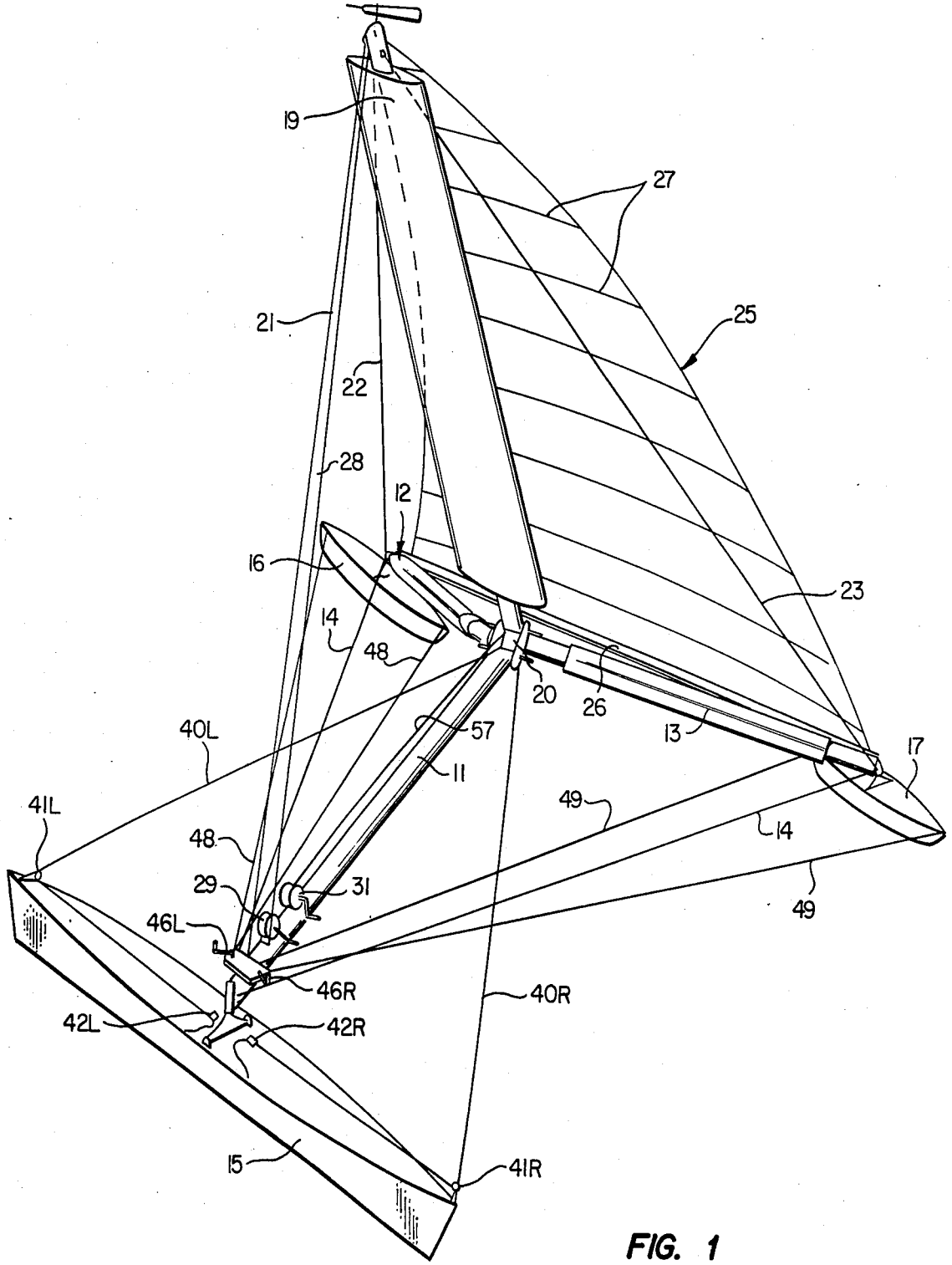
FIG. 1 is a perspective view of a sailboat according to the invention.
Figure 2:
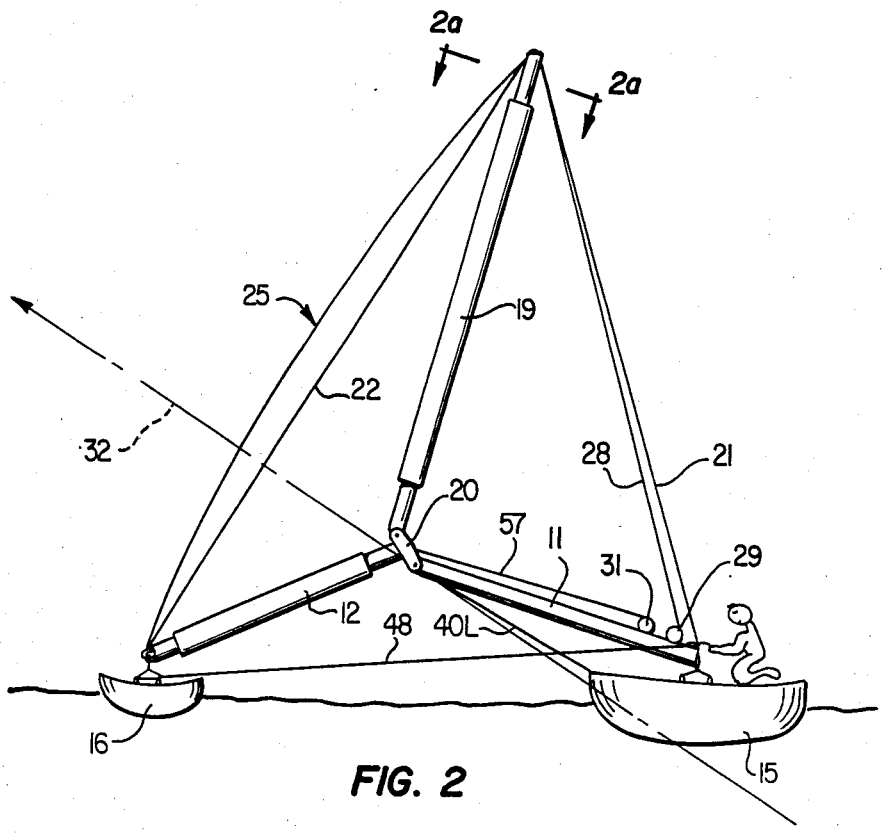
FIG. 2 is an elevation view of the sailboat of FIG. 1, with the lee hulls aligned.
Figure 3:
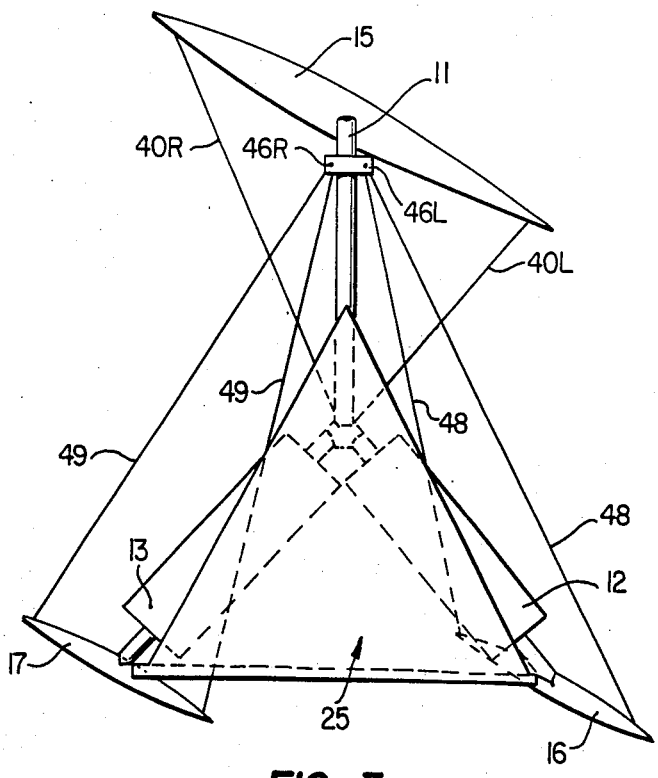
Figure 2B:
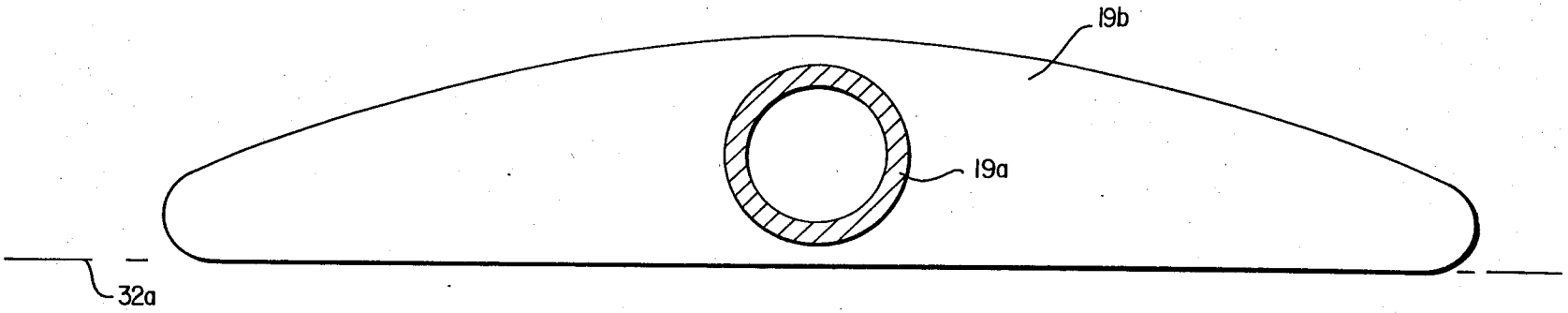
Figure 2A:
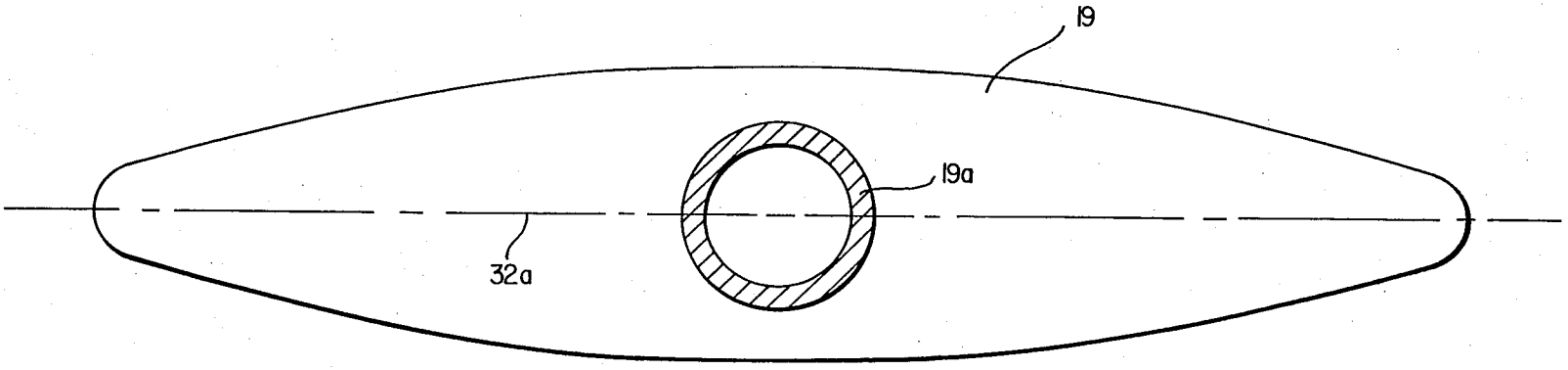
Figure 4:
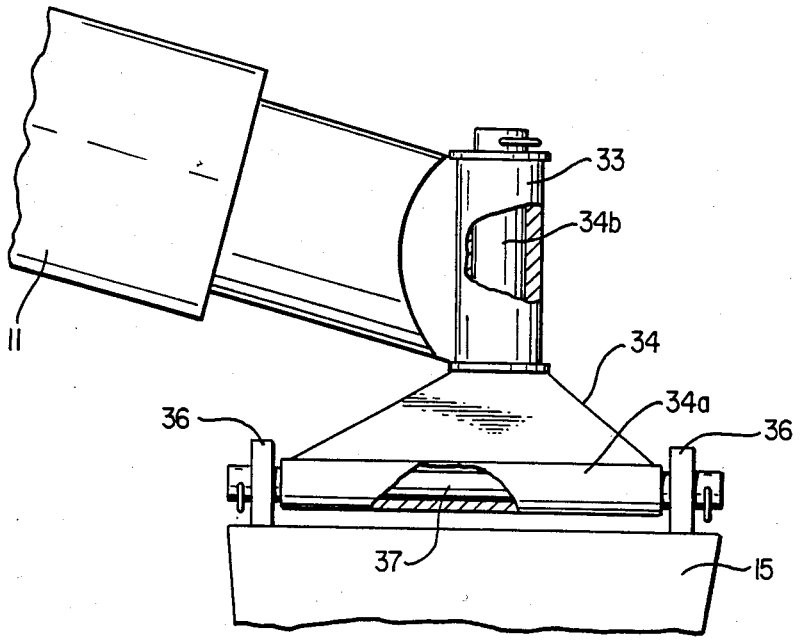
Figure 5:
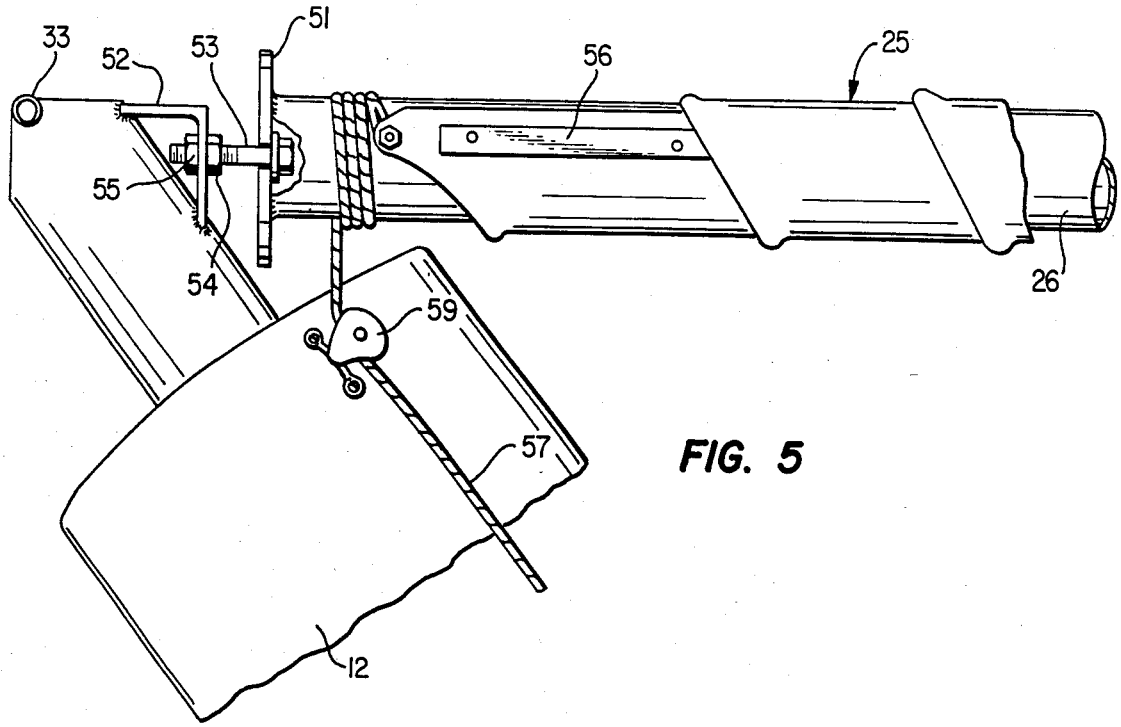
Figure 6:
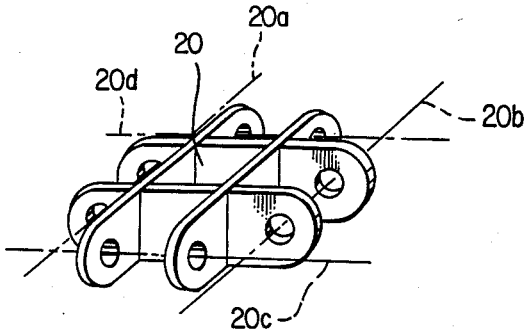
Figure 6A:
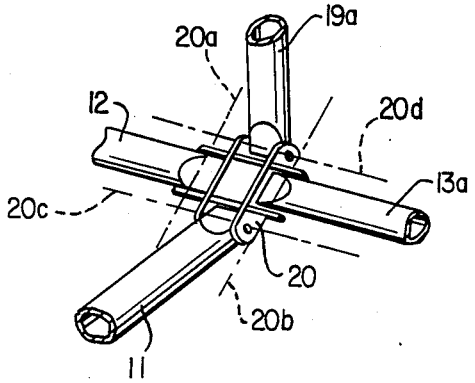
Figure 7:
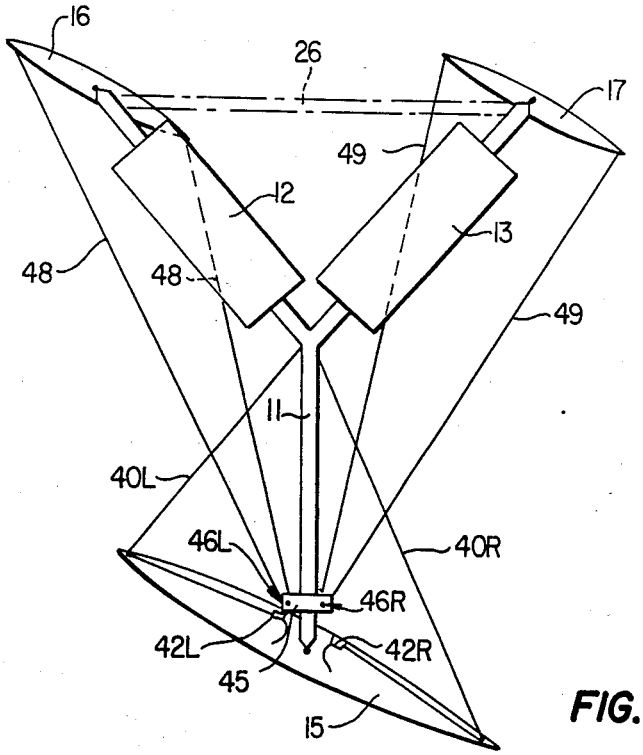
Figure 8:
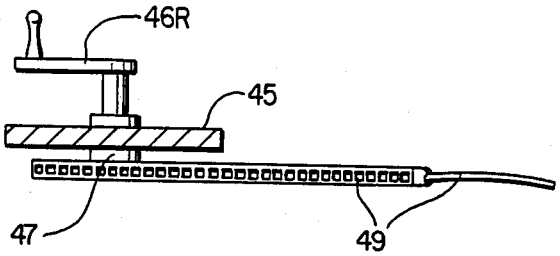
Figure 9:
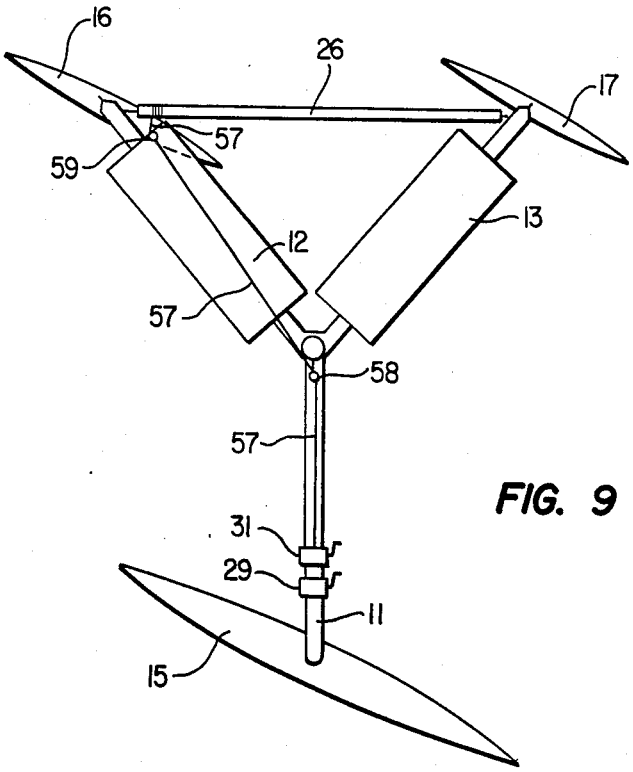

FIG. 2*a* is an end view, partially in section, of one form of spar airfoil;

FIG. 2*b* is an end view, partially in section, of an alternative form of spar airfoil;

FIG. 3 is a top view of the sailboat of FIG. 1;

FIG. 4 is a fragmentary detail view illustrating the coupling of the frame to a hull;

FIG. 5 is a fragmentary detail view of the mounting of one end of the roller boom on a frame spar;

FIG. 6 is a perspective detail view of the frame coupler illustrated in FIG. 1;

FIG. 6*a* is a fragmentary detail view of the frame coupler and frame;

FIG. 7 is a diagrammatic view illustrating the steering of the sailboat hulls;

FIG. 8 is a detail view of the steering control of the lee hulls;

FIG. 9 is a diagrammatic view illustrating the control of the sail; and

Figure 10:
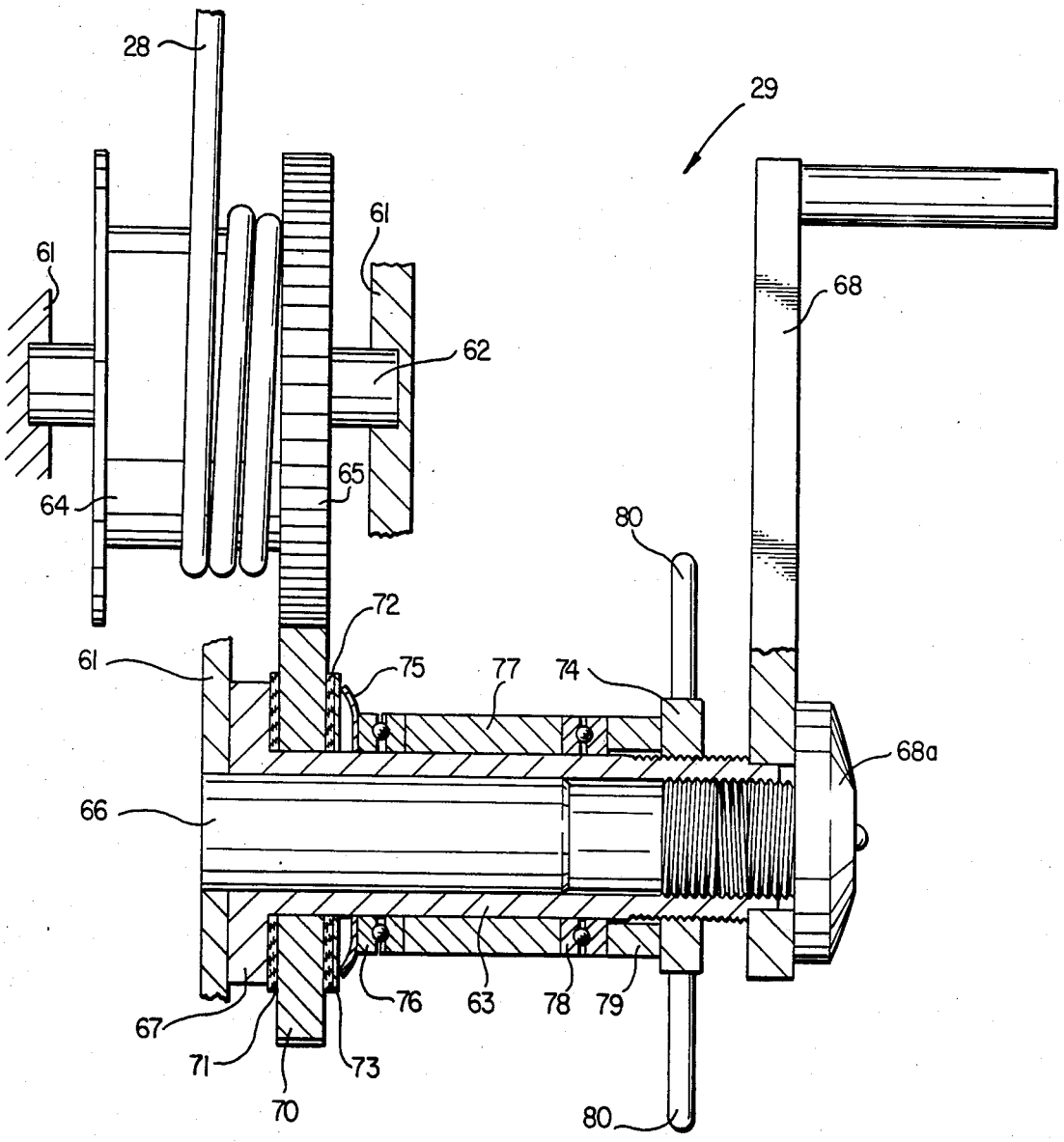

FIG. 10 is a diagrammatic illustration of a halyard winch and associated adjustable friction clutch.

DESCRIPTION OF THE PREFERRED EMBODIMENT

The sailboat frame consists of three legs or spars which are connected together at the center and extend radially outward, with the central juncture of the three spars being elevated somewhat relative to the plane defined by the distal ends of the spars. The distal ends of the spars define three support points at which the frame is supported by three respective independent buoyant bodies or hulls. A generally vertical mast spar extends upward from the frame center point, and is inclined from the vertical as will be described.

Referring now more particularly the drawings, the three frame spars of the boat frame 10 include a windward spar 11, a left lee spar 12 which extends to the left of the windward spar as viewed from its distal end, and a right lee spar 13. These spars are of generally equal length and are connected together at the center. As best seen in FIG. 3, by way of example, the left and right lee spars are spaced angularly from the windward spar about 140°; and the angle between the left and right lee spars is then about 80°.

A windward buoyant body or hull 15 is coupled to a windward support point at the distal end of the windward spar 11; and this windward hull, in the illustrative embodiment, carries the boat pilot. Lee buoyant bodies or hulls, referred to as the left lee hull 16 and the right lee hull 17 are coupled respectively to left and right lee support points of the left and right lee spars 12 and 13 respectively. These lee hulls are smaller than the windward hull 15, in the illustrative embodiment, but the hulls could all be the same size. The coupling of the hulls to the frame includes a vertical rotational axis, to allow for independent steering of the three hulls as will be described.

The mast spar 19 is shown as a single spar, the base of which is connected to the frame at its center point and may be disposed vertically. In the illustrative embodiment, the mast spar is disposed in the vertical plane which includes the windward spar 11, and is inclined toward the windward hull so that the masthead is much closer to the windward hull than it is to the lee hulls. This inclination of the mast spar is best seen in FIG. 2 which is an elevation view of the sailboat with the left and right lee hulls in tandem. The left and right lee spars 12 and 13 and the mast spar 19 are configured as airfoils, functioning as fixed sails, as will be described subsequently.

The three frame spars 11, 12 and 13 and the mast spar 19 are joined together by means of a coupler 20 illustrated in FIG. 6 with the assembly being illustrated in detail in FIG. 6*a*. The coupler 20 is a structural member defining four pivot axes for the above mentioned respective frame and mast spars, which pivot axes are disposed in a common plane. One pair of parallel axes 20*a* and 20*b*, indicated in FIG. 6, define pivot axes for the left and right lee spars 12 and 13 respectively. Another pair of parallel axes 20*c* and 20*d*, indicated in FIG. 6, is perpendicular to the axes 20*a* and 20*b*. The axis 20*c* is the pivot axis for the windward spar 11; and the axis 20*d* is the pivot axis for the mast spar 19. The utilization of this coupler 20 provides a number of advantages which will be described subsequently.

In the working relationship of the frame spars, illustrated in the drawings, the distal ends of the three spars are disposed in a generally horizontal plane, and the juncture of the spars at the coupler 20 is elevated relative to that horizontal plane. The amount of that elevation, that is the vertical distance between that horizontal plane and the coupler 20, is determined by the distance established between the distal ends of the three spars. The distance between the distal ends of the two lee spars is fixed by the roller boom for the sail, to be described. This distance between the distal ends of the windward spar and respective lee spars is fixed by horizontal stays 14 connected between those spars. The position of the mast spar 19 relative to the frame is determined by a back stay 21 connected between the windward spar and the masthead, a left forestay 22 connected betwen the left lee spar and the masthead, and a right forestay 23 connected between the right lee spar and the masthead.

Each of the hulls 15, 16 and 17 has a high length-to-beam ratio, a ratio of at least 7; and the hulls are designed to travel efficiently through the water in opposite directions. For this purpose, the hulls are symmetrical about two planes; a central vertical, transverse plane, and a central, vertical longitudinal plane. In addition to being coupled for independent steering relative to the frame support points, each of the hulls is coupled for independent pitching about a transverse pitch axis which is disposed in that central transverse plane. Each of the hulls then is allowed to pitch independently relative to the frame and follow the water surface. This pitch freedom of the hulls allows the frame to be built much lighter than it would have to be if it had to resist the torsion forces generated by wave action.

With the above described mounting of the hulls, they are prevented from rolling, and are provided with deep V bottom profiles to present minimum resistance to longitudinal movement through the water in both directions and maximum resistance to lateral movement of the hulls. Desirably the hulls, or at least a portion of them, are fabricated from thin sheet metal without internal bulkheads, and are fabricated as closed sealed structures so that the external hull surfaces may be maintained in gentle compound curves by the internal air pressure. Hulls currently used are fiberglass.

The sail 25 for the sailboat is supported generally in a plane defined by the left and right lee support points and the tip of the mast or masthead, these points defining an isosceles triangle. The sail 25 also has the shape of an isosceles triangle defined by a base edge or foot, and two equal side edges. The base edge of the sail is secured to and supported by a roller boom 26 which is rotatably supported between the left and right lee spars, adjacent to the support points thereof; and the sail is reefed by rotating the roller boom to roll the sail onto the boom. To minimize billowing of the sail, a plurality of vertically spaced, horizontal battens 27 are secured in the sail structure, these battens of course being parallel to the sail foot and to the roller boom to allow for the reefing of the sail onto the roller boom. The top of the sail is supported and raised by means of a halyard 28 which is reeved over a pulley at the masthead and is taken upon a winch 29. The halyard winch is mounted on the windward spar 11 adjacent to the windward hull 15 so as to be accessible to the sailboat pilot. A reefing winch 31 is also mounted on the windward spar adjacent to the windward hull for reefing the sail as will be described. With this mounting of the sail, any desired sail area may be presented at any time; and the amount of presented sail area may be readily changed by the boat pilot.

As best seen in FIG. 3, the sail is tilted or inclined substantially from the left and right lee hulls 16 and 17 toward the windward hull 15; and in the operation of the sailboat the windward hull is always to the windward so that the vertical component of the wind force is acting to lift the entire sailboat. The effect of this is to reduce the displacement of the sailboat hulls and correspondingly to reduce the drag as the wind force increases. Also, the overall sail force resultant (indicated by the broken line 32 in FIG. 2) is directed upward along a line passing through (or below) the windward hull 25, so that there is almost no tendency of the boat to capsize.

As mentioned above, each of the mast spar 19 and the lee spars 12 and 13 is configured as an airfoil to function as a fixed sail. FIG. 2*a* is an end view of the mast spar airfoil 19, as viewed from near the top of the mast spar. By way of example the structure of this mast spar 19 may include a spine or column consisting of a 4 inch or 7 inch diameter hollow aluminum spar 19*a*, with the airfoil configuration formed on this aluminum spine from plastic foam and fiberglass or other suitable lightweight material. The airfoil portion of the mast spar 19 may extend substantially the full length of the mast spar, leaving only exposed ends of the spine spar 19*a* for attachment to the coupler 20 at the bottom and for the mounting of stays and pulleys at the top. The airfoil spars may be constructed in any suitable manner, and production airfoils may be fabricated from skin-stressed aluminum, wood, or fiberglass which would have enough column strength to eliminate the need for the central spar, thus saving weight.

As seen in FIG. 2*a*, in cross sectional configuration the airfoil is symmetrical about major and minor transverse axes, with the thickness of the airfoil being about 5 or 6 inches, in relation to the 4 inch diameter spine spar 19*a*, and with the width of the airfoil being about 27 inches. The major transverse axes of this airfoil configuration, indicated by the broken line 32*a*, is referred to as the chord of the airfoil. The two opposite edges of the airfoil are rounded and narrow, since both will function as leading edges in relation to the direction of boat travel, as will be described.

FIG. 2*b* illustrates an alternative form of airfoil spar configuration 19*a*, as viewed from the end. This configuration is again symmetrical about its minor transverse axes, with both of the opposite edges being rounded and narrow since both may function as leading edges in relation to the direction of the boat. In this configuration, however, one side face of the airfoil is flat while the opposite side face is convex. By way of example, this airfoil configuration may have a transverse dimension of about 5 inches, in relation to a 4 inch diameter spine, and the major transverse axis may again be about 27 inches. The flat side face identifies the chord 32*a* of this airfoil configuration; and this flat side face of the mast spar will face the windward side of the boat.

The left and right lee spars 12 and 13 will be configured as airfoils in the same manner as the mast spar 19, and will have the same airfoil cross sectional configuration. In all cases, the airfoil spars 19, 12 and 13 will be oriented with the chords of the spars parallel to the roller boom 26 and therefore parallel with a line extending between the two leeward support points defined by the respective distal ends of the two lee spars. To express this relationship in another way, the chordal planes of the airfoils which include the chords 32*a*, include a line which is parallel to the roller boom 26 or a line extending between the two lee support points.

FIG. 2 of the drawing is a view looking at the sailboat with the two lee support points aligned; and accordingly, in FIG. 2 the airfoils 19 and 12 are viewed from the narrow edges.

It will be seen then, with particular reference to FIG. 2, that the airfoil 19 presents a fixed sail which is inclined toward the windward hull 15 in the same manner as the flexible sail 25, but at a lesser angle from the vertical. By the same token, the lee spars 12 and 13 present fixed sails which are inclined upwardly toward the windward hull 15 in the same manner as the flexible sail 25, but at a much greater angle relative to the vertical. These airfoils, then, all present sail surfaces to the prevailing wind which serve to propel the boat in the desired direction, in the same manner as does the flexible sail 25; and these airfoils are in fact complementary to the flexible said in propelling the boat. Similarly, because of the inclination of the airfoils 19, 12 and 13, they will contribute to the lifting effect produced by the wind force to reduce the displacement and drag of the sailboat hulls.

FIG. 4 is a detail view illustrating the manner in which each of the three hulls are mounted on the boat frame, and is a fragmentary detail view of the windward hull 15 and the associated frame structure. As seen in FIG. 4, the distal end of the windward spar 11 is provided with a vertical bearing sleeve 33 which defines the windward support point of the frame 10. This bearing sleeve is aligned vertically relative to the plane of the water surface, for the normal supported position of the boat frame 10. A yoke 34 includes an integral horizontal bearing sleeve 34*a* and a vertical journal shaft 34*b*, with the sleeve 34*a* and the shaft 34*b* being oriented perpendicular to each other. The journal shaft 34*b* is received within the frame bearing sleeve 33; and these members then define the vertical steering axis for the hull 15 relative to the boat frame.

The windward hull 15 is viewed along its longitudinal axis in FIG. 4; and this hull is provided with brackets 36 which are located on opposite sides of the hull and at the midpoint of the hull length. These brackets support a journal pin 37 which passes through the yoke bearing sleeve 34*a*; and this bearing sleeve and journal pin define the pitch axis of the hull relative to the boat frame.

Each of the hulls 15, 16 and 17 is coupled to the frame 10 in this manner; and the bearing sleeves 33 for the three spars define the respective support points of those frame spars. It will be seen then that each of the hulls is mounted for independent steering relative to the boat frame.

The windward hull 15 is steered or oriented relative to the boat frame by steering lines 40L and 40R. These steering lines are connected to the boat frame near the junction point of the frame spars, pass through respective pulleys 41L and 41R mounted at the ends of the hull 15, and are secured by means of respective cleats 42L and 42R. The position of the windward hull will be changed through the use of these steering lines for different attitudes of the boat relative to the wind; however, the position of this hull will remain fixed relative to the frame once a particular boat attitude has been established.

The two lee hulls 16 and 17 are steered independently of each other; and the steering control for these hulls is illustrated in FIGS. 1, 7 and 8. As best seen in FIG. 1, a table 45 is mounted on the windward spar 11 adjacent to its distal end, for supporting steering cranks 46L and 46R for controlling the steering, respectively of the left lee hull 16 and the right lee hull 17. As best seen in FIG. 8, each crank is supported for rotation in the table 45, and the shaft of the crank extends through the table and has sproket 47 nonrotatably fixed to the shaft beneath the table. As best seen in FIG. 7, a steering line 48 for the left lee hull is attached to the respective ends of the hull and extends around the sprocket 47 of the steering crank 46L. This steering line consists preferably of a sprocket chain portion intermediate its ends which coacts with the sprocket 47, and any other suitable form of line or cable extending between the sprocket chain and the hull. Similarly, a steering line 49 is connected to the ends of the right lee hull and extends around the sprocket 47 associated with the steering crank 46R. Preferably, the steering cranks 46L and 46R will be provided with some form of brake or locking mechanism so that the selected steering orientation of one of these hulls relative to the frame may be fixed and maintained. It will be seen that the swing of the several hulls relative to the frame is limited, as controlled by these steering mechanisms.

The manner of manuevering or controlling the boat will be described subsequently. It will be mentioned here that once the attitude of the boat relative to the wind has been established, the three hulls will be aligned parallel with each other. The boat pilot may then use either the leading lee hull or the trailing lee hull as a boat rudder for maintaining direction and for making minor directional adjustments.

The configuration and mounting of the sail roller boom 26 is best seen in FIG. 5. The roller boom may be fabricated from aluminum tubing, for example, having heavy end plates 51 integrally secured at each end and having central apertures which function as bearing apertures. Brackets 52 are rigidly mounted at the distal ends of the left lee spar and right lee spar. The shanks of headed bolts 53 extend through the end plate apertures and through apertures in the brackets 52; and these bolts are locked in place by nuts 54 and 55. The bolt shanks then define journals for the bearing apertures of the end plates 51, defining the rotational axis for the roller boom; and these headed bolts coacting with the end plates also function as thrust bearings to take up any forces tending to separate the left and right lee spars. The roller boom then functions as a tension member between the spars, coacting with the horizontal stays 14 between these spars and the windward spar to maintain the structural integrity of the boat frame. FIG. 5 also illustrates how the base of the sail 25 is secured to the roller boom by means of a strap 56 bolted to the boom and disposed adjacent to the base and boltrope of the sail.

To effect the reefing of the sail, a reefing line as best seen in FIG. 9 extends from the reefing winch 31 through a pulley 58 mounted adjacent to the juncture of the boat frame, through a pulley 59 mounted adjacent to the distal end of the left lee spar 13 and is wound around the roller boom 26 adjacent to its left end, with the distal end of the line secured to the roller boom. When the sail is fully reefed, only a few turns of the reefing line are wound around the boom; and when the sail is raised by means of the halyard 28 and halyard winch 29, additional turns of the reefing line are wound about the roller boom.

Preferably the halyard winch is provided with some form of adjustable clutch to maintain a preselected tension on the halyard. FIG. 10 of the drawing illustrates, diagrammatically and by way of example, one form of winch assembly suitable for use as the halyard winch 29. FIG. 10 illustrates housing portions 61 of the assembly 29 which rotatably support a reel shaft 62 and a crank shaft 63. A reel 64 for the halyard 28 includes a reel gear 65 by means of which the reel is driven and controlled.

The crank shaft 63 is hollow, and is rotatably mounted on a journal post 66 fixed to one of the housings portions 61. The crank shaft 63 includes an itnegral radial flange 67 at one end functioning as a drive flange; and includes means at its other end for nonrotatably mounting the crank 68. A drive gear 70 is rotatably mounted on the drive shaft 63, in driving relation with the reel gear 65, and is separated from the drive flange 67 by a friction drive disk 71. This friction drive disk and a second friction drive disk 72 disposed on the oppositet side of the drive gear, and an associated bearing washer 73, define a friction drive or coupling between the crank shaft 63 and the drive gear 70, with the friction of this drive coupling being adjustable by a mechanism to be now described. The cross section of the crank shaft 63 may be flatted, or otherwise non-circular, so that the bearing washer 73 may be mounted on the shaft in nonrotating relation, that is to rotate with the shaft 63.

The adjustable friction mechanism includes the following components which are rotatably mounted on the drive shaft 63 and stacked from left to right in FIG. 10 between the bearing washer 73 and tension adjusting nut 74 which is threadedly mounted on the drive shaft: a Bellville spring 75, a thrust bearing 76, a spacer 77, a second thrust bearing 78, and a second spacer 79. The tension adjusting nut 74 includes radial arms 80 to enable rotation of the nut to select the tension to be placed on the halyard. It will be seen that rotation of the tension adjusting nut in one direction will compress the belville spring to increase the drive friction for the drive gear, and that rotation in the opposite direction will of course decrease the drive friction.

In operation, assuming that clockwise rotation of the handle 68 effects takeup of the halyard 28 on the reel 64, reversible counterclockwise rotation of the drive shaft is prevented selectively (by means not shown) so that the above described friction drive coupling or clutch will retard rotation of the drive gear 70 and spool 64 according to the selected amount of applied friction. The tension adjustment nut should be adjusted to maintain the necessary tension on the halyard to raise the sail and to maintain the sail under normal wind conditions. With wind gusts or wind of excessive force, the friction clutch will allow the drive gear to rotate relative to the crank shaft and release tension on the halyard. For reefing the sail, the tension on the halyard may be released by lessening the clutch friction to allow for reefing of the sail by means of the reefing winch 31.

One function of this halyard winch adjustable clutch is to provide a safety feature, enabling the pilot to set a maximum tension on the halyward and thereby limit forces on other parts of the boat resulting from wind gusts for example, and therefore minimize the possibility of structural failure of the boat. Another function is to assist in the reefing of the sail, maintaining some tension on the halyard to assure smooth take up of the sail onto the roller boom.

It will be seen that, with this arrangement, the sail is reefed by taking up the reefing line by means of the reefing winch which effect rotation of the roller boom to reef the sail; and the clutch of the halyard winch should be adjusted to maintain some tension on the halyard and allow smooth reefing of the sail onto the roller boom. It will also be seen that, with this arrangement, the sail may be partially reefed at any time that the wind becomes too strong to utilize the full sail area or, to put it another way, any desired amount of sail may be presented to the wind at the option of the boat pilot.

Operation

The control of the sailboat from the standpoint of setting different courses relative to the wind direction is much more complicated than that of a conventional sailboat. For putting the sailboat in motion, all three hulls are aligned parallel to each other and at a desired angle relative to the sail roller boom 26. If the lee hulls are aligned parallel with the roller boom, the motion of the sailboat will stop, unless the boat happens to be heading downwind.

For a slight change of direction once a course is established, either the leading lee hull or the trailing lee hull may be turned relative to the other hulls; and this will cause the entire sailboat to change direction. When the new heading is achieved, the control hull is then returned to parallel alignment with the other hulls. To make a more significant turn from a tack to a reach for example, the two lee hulls may be turned simultaneously a desired number of degrees by means of the respective cranks 46 and this will produce an abrupt change in boat direction. Depending on the keel action of the windward hull, the windward hull should be aligned parallel with the lee hulls as soon as possible. This will produce an abrupt change in the boat's direction without change in the angle of the sail boom relative to the wind. It may then be desired to change that angle of the sail boom, to better utilize the wind for speed, and this is accomplished by changing the direction of the lee hulls relative to the boom one by one until the desired boom angle is achieved and again aligning the windward hull with the lee hulls.

For coming about, from a port tack to a starboard tack for example, it is necessary to stop the motion of the sailboat and proceed in a different direction in which the hulls are moving in the water in the opposite direction from the previous tack. That is, what was the leading ends of the hulls would now become the trailing ends and vice versa. To accomplish this, the two lee hulls may first be aligned parallel with the boom. This will cause the motion of the boat to stop. When the formerly leading hull is now turned to the opposite direction relative to the boom (the hull position for the new tack), the sailboat will turn through the wind toward the position for the new tack. During this turn, the windward hull will be moving very slowly and should be turned parallel with the formerly leading hull. When the sailboat turn or swing approaches the position for the new tack, the now leading lee hull should be turned parallel with the other hulls and the boat attitude or position relative to the wind is now established on the new tack.

The operation of the sailboat in high winds is facilitated and is made much safer because of the ability to reef the sail quickly and because of the fixed sail structure which enables much improved boat maneuverability with little or no flexible sail aloft. When it is necessary to reduce the area of the flexible sail, as evidenced by slippage of the friction clutch on the halyard winch, that sail area may be quickly reduced in a controlled manner by using the reefing winch. The amount of sail area that can be retained aloft is almost infinitley variable, so that the maximum amount of flexible sail can be maintained aloft in relation to the sailing conditions, with the ability to reduce that area aloft quickly if necessary. Because of the design of the mast spar and the two leeward frame spars as fixed sails, the overall lift to drag ratio of the boat rigging is sufficiently high that the sailboat can sail into the wind even without any flexible sail aloft. This improved maneuverability of the sailboat, either with or without some of the flexible sail aloft, may enable the preventing of a damaging accident in a high wind situation.

What has been described is a multiple-hull sailboat which is light in weight, which can carry sail of much larger area in relation to its weight than known multiple-hull sailboats, and which therefore is a faster boat than such known sailboats.

A feature of the sailboat according to the invention is that one of the three hulls is always the windward hull, and the other two hulls are lee hulls, that the flexible sail is supported on the boat in a plane defined generally by the two lee hulls and the masthead which is disposed generally above the windward hull so that the sail is inclined upwardly from the lee hulls toward the windward hull, with the result that the sailboat does not heel and the possibility of the boat capsizing is almost nil.

A further feature of the invention is that the flexible sail is mounted on a roller boom supported between the two lee hulls, whereby the sail may be reefed by taking up the sail on the roller boom and is raised by means of a halyard reeved over the masthead. A related feature of the invention is that the roller boom may be operated by a reefing winch, and the halyard may be taken up by means of a halyard winch having an adjustable clutch control to preset the maximum tension on the halyard.

Another feature of the invention is that by providing the frame and mast spars as airfoils functioning as fixed sails, certain members of the rigging which would otherwise produce a substantial portion of the rigging drag are designed in conjunction with the overall boat design not only to substantially reduce drag but to produce lift such that the lift-to-drag ratio of these members is very greatly improved, and such that the overall lift-to-drag ratio of the boat rigging is improved.

A still further feature and advantage of the invention is that, with these spars so constructed, the overall lift-to-drag ratio of the boat without the flexible sail aloft is sufficiently great to enable the boat to sail to windward, thereby making the boat much more maneuverable and safer to operate in high winds.

Another feature of the invention is that the three hulls are mounted to be steered independently relative to the boat frame; and that controls are provided for the separate steering of each of the three boat hulls to provide for the desired maneuvering and control of the sailboat.

Still another feature of the invention is that, because of the roller boom reefing of the sail, the amount of sail area presented to the wind may be selected by the boat pilot and may be changed very quickly by the boat pilot to accommodate varying wind conditions.

While the preferred embodiment of the invention has been illustrated and described, it will be understood by those skilled in the art that changes and modifications may be resorted to without departing from the spirit and scope of the invention.

What is claimed is:

1. A sailboat comprising a tripod frame supported on the water by three independent buoyant hulls; said tripod frame comprising three spars extending outwardly and downwardly from a center juncture point, and providing hull support points at the respective distal ends of said spars; said frame spars including a windward spar providing a windward support point and two leeward spars providing two leeward support points;

a mast spar mounted on said frame at said center juncture point with its masthead disposed equidistant from said leeward support points and toward said windward support point;

said three independent buoyant hulls being coupled to said three frame support points, for rotation about respective vertical axes; said mast spar being configured, at least in part, as an airfoil symmetrical about its longitudinal axis with both edges as leading edges; with the chord of said airfoil being fixed in a plane parallel with a line between said leeward support points.

2. A sailboat as set forth in claim 1 including said mast spar being a linear spar inclined from said center juncture point toward said windward support point.

3. A sailboat as set forth in claim 1 said leeward spars each being configured, at least in part, as an airfoil symmetrical about its longitudinal axis with both edges as leading edges, with the chord of said airfoil being fixed in a plane parallel with a line between said leeward support points.

4. A sailboat as set forth in claim 3 including a sail mounted on said sailboat for disposition generally in a plane defined by said two leeward support points and said masthead, whereby said sail is inclined from said leeward support points toward said windward support point.

5. A sailboat as set forth in claim 4 including a generally horizontal roller boom mounted on said frame and extending generally between said leeward support points;

said sail having its foot attached to said roller boom, whereby said sail may be reefed by rolling onto the boom to present 0 percent to 100 percent sail area to the wind.

6. A sailboat as set forth in claim 3 including said airfoils having narrow edges and having one flat face and one convex face, said flat faces defining the chords of said airfoils; said airfoils being mounted with said flat faces facing toward said windward support point.

7. A sailboat as set forth in claim 3 including said airfoils having narrow edges and having opposed convex faces symmetrical about respective major transverse axes, said major transverse axes defining the chords of said airfoils.

8. A sailboat as set forth in claim 3 including said airfoils eaching having a chord about five times its maximum thickness.

9. A sailboat as set forth in claim 1 including a sail mounted on said sailboat for disposition generally in a plane defined by said two leeward support points and said masthead, whereby said sail is inclined from said leeward support points toward said windward support point.

10. A sailboat as set forth in claim 9 including the foot of said sail being supported generally parallel with a line between said leeward support points.

11. A sailboat as set forth in claim 9 including a generally horizontal roller boom mounted on said frame and extending generally between said leeward support points;

said sail having its foot attached to said roller boom, whereby said sail may be reefed by rolling onto the boom to present 0 percent to 100 percent sail area to the wind.

12. A sailboat as set forth in claim 11 including said sail being triangular in shape; the top of said sail being secured by a halyard reefed at said masthead;

a halyard winch mounted on said frame for the reeling of said halyard; said halyard winch having an adjustable friction clutch to limit the maximum tensile force that may be imposed on said halyard by said sail.

13. A sailboat as set forth in claim 9 including said sail having an elongated foot secured along a line adjacent to and parallel to a line between said leeward support points;

means mounting said sail in a manner to enable letting out or taking in a portion only of said sail, relative to said foot, to present a selected sail area to the wind.

14. A sailboat as set forth in claim 10 including said sail being triangular, whereby a triangular sail area of selected size is presented to the wind.

15. A sailboat as set forth in claim 1 including said buoyant hulls each being horzontally elongated and configured for efficient movement through the water in either of two opposite directions;

means for coupling each of said buoyant hulls to a respective frame support point, so that all hulls may pitch freely but are not allowed to roll, and may be steered about their yaw axes by the pilot.

16. A sailboat as set forth in claim 15 including means for steering each of said hulls independently relative to said frame to position, selectively, one or the other of said leeward hulls as the lead hull and to position, selectively, one or the other of the ends of each of the three hulls as the leading ends thereof.

17. A sailboat as set forth in claim 1 including steering means for each of said three hulls.

18. A sailboat as set forth in claim 1 including said airfoil having narrow edges and having one flat face and one convex face, said flat face defining the chord of said airfoil; said airdoil being mounted with its flat face facing toward said windward support point.

19. A sailboat as set forth in claim 1 including said airfoil having narrow edges and having opposed convex faces symmetrical about its major transverse axis, said major transverse axis defining the chord of said airfoil.

20. A sailboat as set forth in claim 1 including said airfoil having a width about five times its maximum thickness.

* * * * *

UNITED STATES PATENT AND TRADEMARK OFFICE

CERTIFICATE OF CORRECTION

PATENT NO. : 4,708,075

DATED : November 24, 1987

INVENTOR(S) : Edwin des Snead

It is certified that error appears in the above-identified patent and that said Letters Patent is hereby corrected as shown below:

column 1, line 19 "in" should read -- is --.

column 8, line 66, "halyward" should read -- halyard --.

column 9, line 7, "effect" should read -- effects --.

column 12, line 34, "claim 10" should read -- claim 13 --.

column 12, line 57, "airdoil" should read -- airfoil --.

Signed and Sealed this

Ninth Day of August, 1988

*Attest:*

*Attesting Officer*

DONALD J. QUIGG

*Commissioner of Patents and Trademarks*